US005580043A

United States Patent [19]

Gelb, Jr. et al.

[11] Patent Number: 5,580,043

[45] Date of Patent: Dec. 3, 1996

[54] COMPENSATING PRESSURE ROLLER

[75] Inventors: Joseph Gelb, Jr., Milford; Edward M. Ifkovits, Jr., New Fairfield, both of Conn.

[73] Assignee: Pitney Bowes Inc., Stamford, Conn.

[21] Appl. No.: 547,052

[22] Filed: Oct. 23, 1995

[51] Int. Cl.[6] ..... B65H 5/06

[52] U.S. Cl. ..... 271/274; 271/272; 271/314; 198/624

[58] Field of Search ..... 271/272, 274, 271/314; 198/843, 836.2, 624; 101/171; 226/181, 186, 187, 190, 191, 194

[56] References Cited

U.S. PATENT DOCUMENTS

| | | | |
|---|---|---|---|
| 3,021,134 | 2/1962 | Appell | 271/274 |
| 3,219,176 | 11/1965 | Kirdig | 198/843 |
| 4,170,350 | 10/1979 | Conti | 271/274 |
| 4,496,257 | 1/1985 | Habelt et al. | 226/190 |
| 4,557,613 | 12/1985 | Tallian et al. | 384/568 |
| 4,669,050 | 10/1987 | Heise | 100/168 |
| 4,705,413 | 11/1987 | Arnoldi et al. | 400/56 |
| 5,044,624 | 9/1991 | Haus et al. | 271/314 |
| 5,142,758 | 9/1992 | Delhaes | 29/117 |
| 5,203,555 | 4/1993 | Cannaverde et al. | 271/63 |
| 5,397,289 | 3/1995 | Entz et al. | 492/17 |
| 5,419,242 | 5/1995 | van Haag | 100/47 |

FOREIGN PATENT DOCUMENTS

| | | | |
|---|---|---|---|
| 93002956 | 2/1993 | WIPO | 226/190 |

*Primary Examiner*—H. Grant Skaggs

*Attorney, Agent, or Firm*—Angelo N. Chaclas; Charles R. Malandra, Jr.; Melvin J. Scolnick

[57] ABSTRACT

A pressure roller assembly for use in a transport system. The transport system including a drive system in operative engagement with the pressure roller assembly for feeding an article in a path of travel. The pressure roller assembly including: a shaft; a roller having an inner diameter; a pair of first hubs each having a bearing surface and fixably mounted to the shaft in spaced apart relationship so that the first hub bearing surfaces are facing each other; a pair of second hubs each including an through hole having a diameter greater that the shaft diameter and a bearing surface corresponding to the first hub bearing surfaces, respectively, the second hubs spaced along the shaft between the first hubs and slideably mounted to and in bearing engagement with the roller inner diameter so that the second hub bearing surfaces are facing the first hub bearing surfaces, respectively; and means for biasing the second hub bearing surfaces into bearing engagement with the first hub bearing surfaces, respectively.

6 Claims, 3 Drawing Sheets

COMPENSATING PRESSURE ROLLER

FIELD OF THE INVENTION

This invention relates generally to pressure rollers, also commonly known as normal force rollers and idler rollers, for use in an article transport system. More particularly, this invention is directed to a compensating pressure roller which accommodates articles of variable thickness.

BACKGROUND OF THE INVENTION

Machines which process flat articles, such as paper, envelopes, tape and film, are well known in the art. Although the machines take on a wide variety of configurations depending upon the particular functions which they are designed to perform, they all share some common features. Typically, the machines include a transport system for transporting the article along a feed path through the machine. The transport system usually consists of a belt, roller or O-ring drive system and pressure rollers which work cooperatively to feed the article. Pressure rollers are disposed above the drive system so that the article passes between the nip of the drive system and pressure rollers during feeding. Generally, the pressure rollers are spring biased toward the drive system. In this manner, the pressure rollers prevent slippage of the article during feeding by keeping the article in physical contact with the drive system. A few examples of machines employing drive systems with associated pressure rollers are: postage meters, mailing machines, inserters and photographic film processing apparatus.

Article processing machines often require the transport system to have the capability to automatically accommodate various thicknesses of flat articles. This allows the machines to process a variety of articles having different sizes and configurations without the need for operator intervention. Thus, it is known in the prior art to have pressure rollers that deflect away from the drive system in proportion to the thickness of the article as the article passes through the nip and then return to a home position after the article leaves the nip.

Many different approaches are known which achieve this result. A first approach is to rotatively mount the pressure roller to one end of an arm using a shaft while pivotally mounting the other end of the arm in a location that does not interfere with the feed path of the article. A spring is then operatively coupled to the arm so as to bias the pressure roller against the drive system. Thus, when the article enters the feed nip, the arm pivots and lifts the roller away from the drive system. Accordingly, the spring bias keeps the pressure roller in contact with the article and returns the pressure roller into contact with the drive system after the article leaves the feed nip. A second approach is to rotatively mount the pressure roller to an extended shaft and rotatively mount the ends of the shaft to bearing blocks. The bearing blocks are then slideably mounted in slots located in any suitable fixed structure. Analogous to that of the first approach, the bearing blocks are spring loaded so that the pressure roller is biased toward the drive system.

Although these prior art approaches generally work well, they suffer from certain drawbacks. First, the springs must be particularly adapted to the thickness and weight of the article as well as the speed with which the article is being fed. If the spring rate is too small, then the pressure roller may bounce (deflect too much too fast) due to the impact of the article and provide insufficient force on the article to maintain it in contact with the drive system. If the spring rate is too large, then the pressure roller may drag (not deflect enough) and provide excessive force on the article. Both of the conditions are undesirable because jams and the destruction of the article are likely to result. Thus, manual adjustments to the pressure roller assembly are often necessary depending upon the configuration of the article. Second, these systems are not well adapted to accommodate off center loading. If only a portion of the pressure roller is in contact with the article, then one end of the roller tends to deflect more than the other end of the roller. Off center loading also occurs when stepped mail is processed by envelope handling apparatus. Stepped mail does not have uniform thickness across its width (the direction transverse to the path of travel) due to the contents located inside the envelope. In these situations, the bearing blocks tend to bind because they are not deflecting uniformly. As a result, uneven pressure is supplied to the article and jams and the destruction of the article are again likely.

Accordingly, there is a need for a pressure roller assembly that accommodates a wide variety of articles having different thicknesses without the need for manual adjustment. Additionally, there is also a need for a pressure roller assembly that accommodates off center loading without binding and which supplies more uniform pressure to the article.

SUMMARY OF THE INVENTION

The present invention provides a pressure roller assembly for use in a transport system that substantially alleviates the problems associated with the prior art. The transport system including a drive system in operative engagement with the pressure roller assembly for feeding an article in a path of travel. In accordance with the present invention, the pressure roller assembly includes: a shaft; a roller having an inner diameter; a pair of first hubs each having a bearing surface and fixably mounted to the shaft in spaced apart relationship so that the first hub bearing surfaces are facing each other; a pair of second hubs each including an through hole having a diameter greater that the shaft diameter and a bearing surface corresponding to the first hub bearing surfaces, respectively, the second hubs spaced along the shaft between the first hubs and slideably mounted to and in bearing engagement with the roller inner diameter so that the second hub bearing surfaces are facing the first hub bearing surfaces, respectively; and means for biasing the second hub bearing surfaces into bearing engagement with the first hub bearing surfaces, respectively.

In accordance with the present invention the roller is not fixably mounted to the shaft as in the prior art, but instead is suspended around the shaft utilizing the first hub and second hub bearing surfaces. Additionally, although the first hubs are fixably mounted to the shaft, the second hubs are independently coupled to the roller inner diameter and their corresponding first hub. The result of this arrangement is a pressure roller assembly that accommodates a wide range of articles and feed speeds without the need for operator adjustment.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention. As shown throughout the drawings, like reference numerals designate like or corresponding parts.

DETAILED DESCRIPTION OF THE PREFERRED EMBODIMENT

Figure 1:
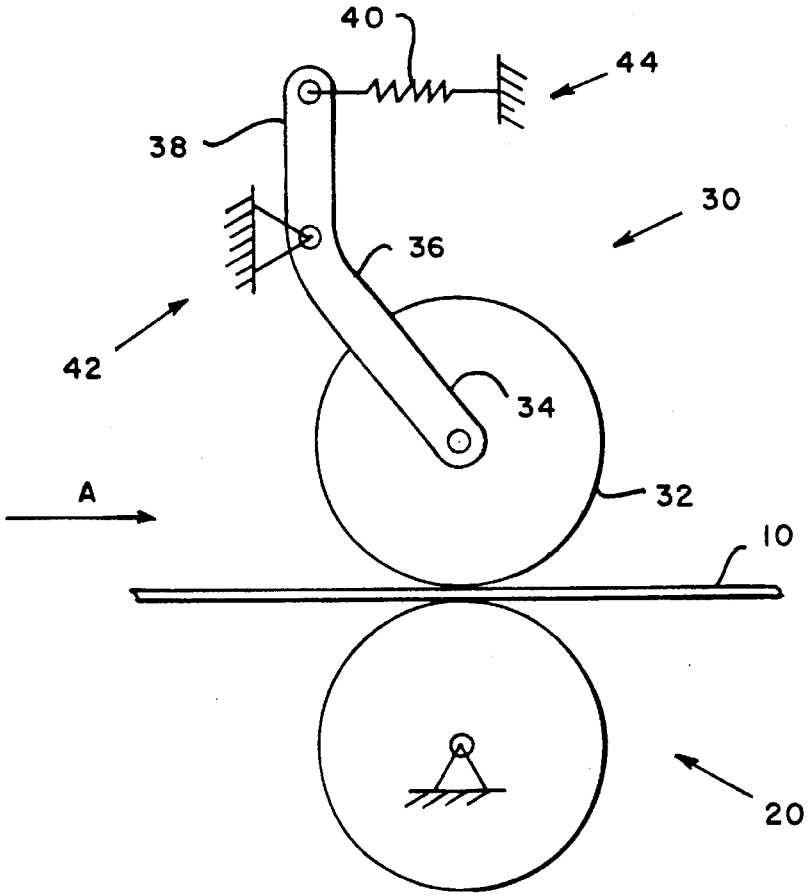
FIG.1 (PRIOR ART)
FIG. 1 is an elevational view looking transverse to a path of travel of an article of a first prior art pressure roller assembly.

Referring to FIG. 1, a prior art pressure roller assembly 30 representative of the first approach, as described above, is shown. The assembly 30 includes an arm 36, a pressure roller 32 rotatively mounted to one end 34 of the arm 36 and an extension spring 40. The arm 36 is pivotally mounted along its length to any suitable fixed structure 42 while the spring 40 extends between the other end 38 of the arm 36 and any suitable fixed structure 44. The force of the spring 40 tends to rotate the arm 36 in a clockwise direction and thus biases the roller 32 into operative engagement with any suitable drive system 20. As an article 10 passes through the nip between the drive system 20 and the roller 32, the arm 36 pivots counter clockwise causing the roller 32 to pivot away from the drive system 20 to compensate for the thickness of the article 10. As used herein, the article 10 refers to any item which is desired to be fed, such as: a sheet of paper, a plurality of sheets of paper, folded sheet or sheets of paper, cardboard, an envelope, an envelope w/enclosures, a booklet, film, tape or any other substantially flat media.

Figure 2:
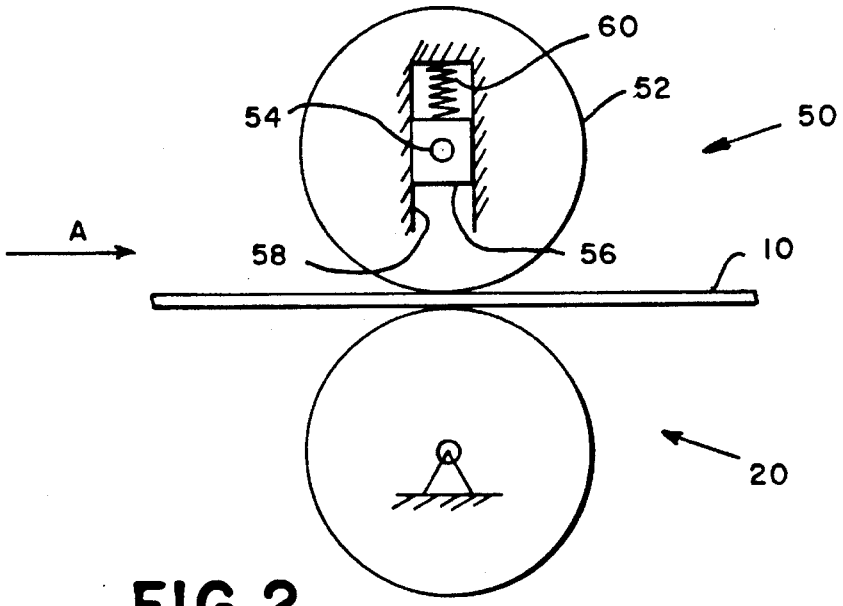
FIG.2 (PRIOR ART)
FIG. 2 is an elevational view looking transverse to a path of travel of an article of a second approach prior art pressure roller assembly.

Referring to FIG. 2, a prior art pressure roller assembly 50 representative of the second approach, as described above, is shown. The assembly 50 includes a shaft 54, a pressure roller 52 mounted to the shaft 54, a pair of bearing blocks 56 and a pair of compression springs 60. The ends of shaft 54 are respectively mounted in bearing blocks 56 which are in turn each slideably mounted in respective slots 58 located in any suitable fixed structure. The compression springs 60 extend in the slots 58 between the bearing blocks 56 and the fixed structure. The force of the spring 60 tends to push the shaft 54 downward toward the drive system 20 and thus biases the roller 52 into operative engagement with the drive system 20. As an article 10 passes in through the nip between the drive system 20 and the roller 52, the bearing blocks 56 move vertically in the slots 58 and carry the roller 52 away from the drive system to compensate for the thickness of the article 10.

Figure 3A:
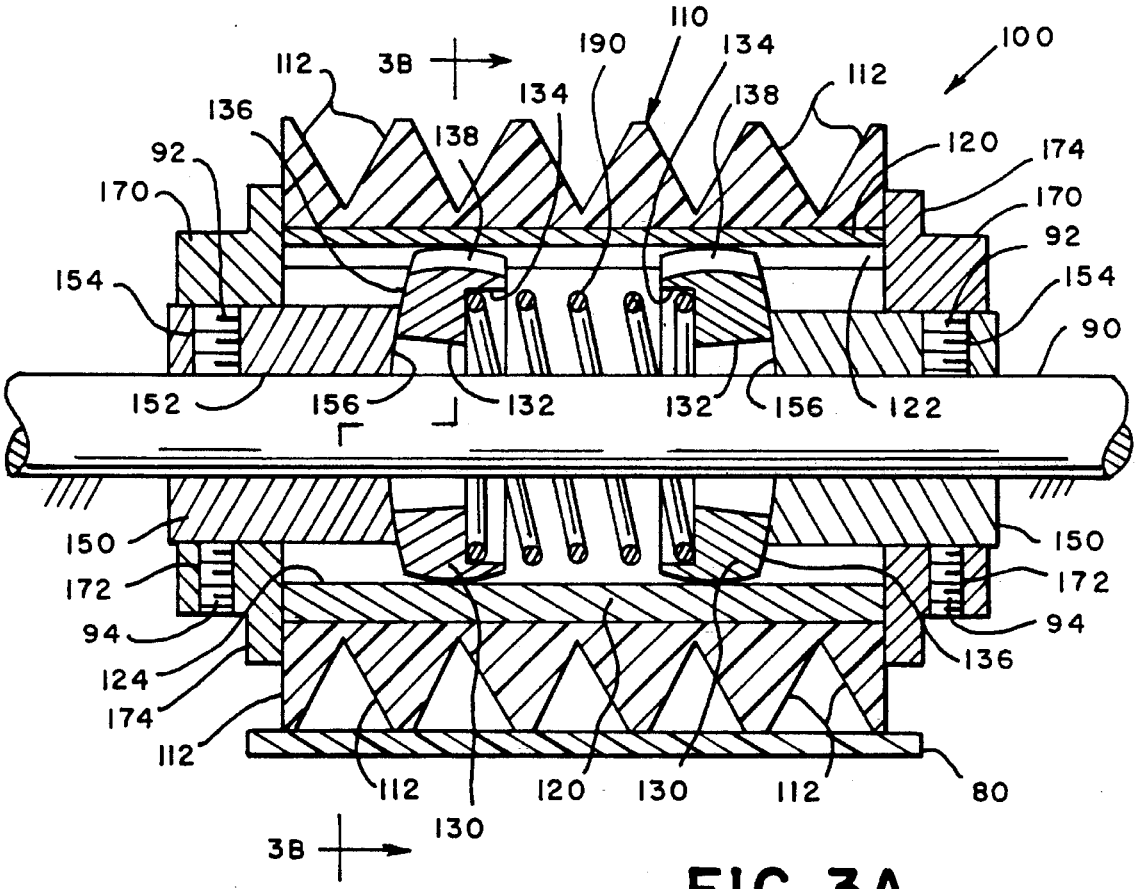
FIG. 3A is a sectional elevational view looking along a path of travel of an article of a pressure roller assembly in a home position in accordance with the present invention.
Figure 3B:
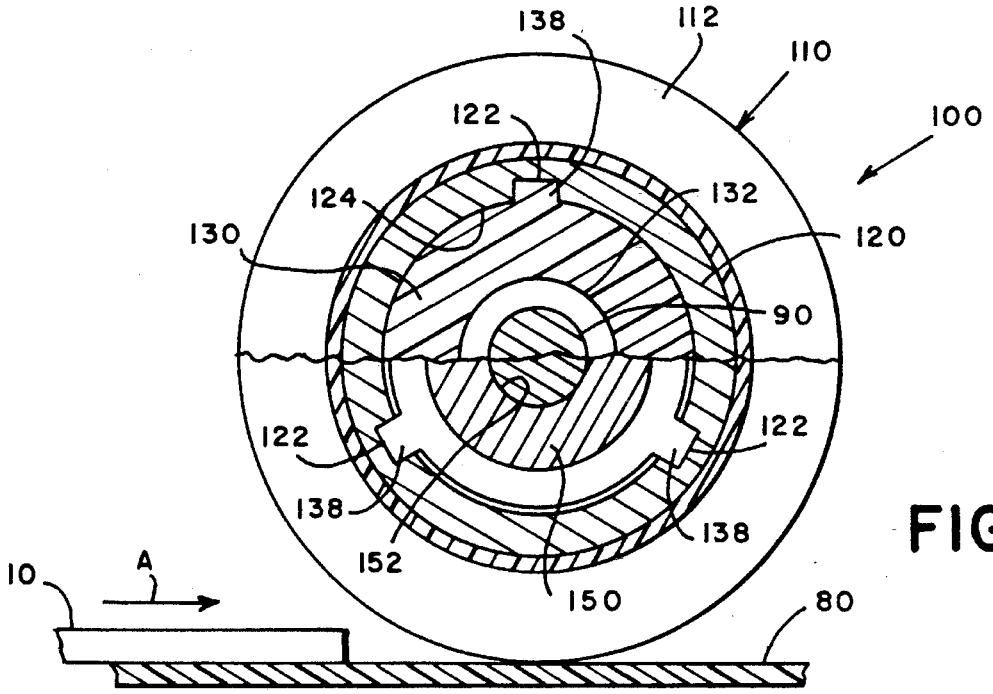
FIG. 3B is a sectional view taken along 3B—3B as shown in FIG. 3A.

Referring to FIGS. 3A and 3B, a compensating pressure roller assembly 100 fixably mounted on a shaft 90 in accordance with the present invention is shown in a home position when the article 10 is not yet in contact with the pressure roller assembly 100. In the preferred embodiment, the shaft 90 is fixably mounted on each end to any suitable structure (not shown) by conventional means (not shown). The pressure roller assembly 100 includes a roller 110 having a plurality of circumferential ribs 112, a sleeve 120, a pair of male hubs 130, a pair of female hubs 150, a pair of collars 170 and a compression spring 190. The shaft 90 and the pressure roller assembly 100 are positioned such that in the home position the ribs 112 are in contact with a belt type drive system drive system 80.

The roller 110 is fixably mounted to the sleeve 120 so that the roller 110 and the sleeve 120 rotate together as an integral unit. The sleeve 120 is preferably made of steel and includes a plurality of grooves 122 and an axial through hole 124. So that no slippage occurs between the roller 110 and the drive system 80, the roller 110 is made from a suitably elastic material such as urethane having a durometer of approximate ninety. Thus, as the drive system 80 advances from left to right as viewed in FIG. 3B, the roller 110 rotates accordingly and together they feed the article 10 in a path of travel as indicated by arrow "A".

The female hubs 150 are cylindrical in shape and each include an axial through hole 152, a radial threaded hole 154 and a concave spherical surface 156 on one end. The center point of the concave spherical surface 156 is located on the axis of the hole 152. The hole 152 is dimensioned to provide a close slip fit between the female hubs 150 and the shaft 90. To fixably mount the female hubs 150 to the shaft 90, the female hubs 150 are spaced apart along the shaft 90 so that the respective concave surfaces 156 are facing each other. It is important to note that the axis of the concave spherical surface 156 is aligned with the axis of the hole 152. A set screw 92 is threaded through hole 154 to secure the hubs to the shaft 90.

The male hubs 130 each include an axial conical through hole 132, a recess 134 on one end, a convex spherical surface 136 on the other end and a plurality of tabs 138 which are radially aligned with the grooves 122 in the sleeve 120. The center point of the convex spherical surface 136 is located on the axis of the hole 132. Thus, the male hubs 130 are slideably mounted to the sleeve 120 so that the recesses 134 are facing each other. The male hubs 130 are aligned along the shaft 90 so that the surfaces 136 are facing the surfaces 156 of the female hubs 150. It is important to note that the axis of the convex spherical surface 136 is aligned with the axis of the hole 132. Additionally, the hole 132 is dimensioned so that clearance exists between it and the shaft 90. The compression spring 190 is retained by and extends between the recesses 134 of the male hubs 130 with a predetermined preload. In this manner, the compression spring 190 biases the male hubs 130 outward and maintains the surfaces 136 of the male hubs 130 in operative engagement with the respective surfaces 156 of the female hubs 150. It should be apparent that the surfaces 136 and 156 have the same radial dimension so that they are complete contact with each other.

The collars 170 are fixably mounted to the female hubs 150 by a set screw 94 threaded through radial hole 172. Each collar 170 includes a flange 174 which extends radially beyond the sleeve 120 to prevent the roller 110 from sliding axially along the male hubs 130. It should be apparent that the flanges 174 do not extend out as far as the ribs 112 so as not to come into contact with the article 10 during feeding.

In the home position, the axes of the shaft 90, the hole 132 of the male hubs 130, the convex spherical surfaces 136 of the male hubs 130, the hole 152 of the female hubs 150, the concave spherical surfaces 156 of the female hubs 150, the sleeve 120, the roller 110 and the compression spring 90 are all in alignment. This is due to the preload of the compression spring 90 forcing the male hubs 130 outward and the tendency of all mechanisms to find a state of equilibrium where all the forces are in balance. Therefore, it is important that the male hubs 130 and the female hubs 150 are made of a suitable low friction material, such as an acetyl based plastic, so that the concave spherical surface 156 of the female hubs 150 and the convex spherical surface 136 of the male hubs 130 slip past each other freely as they bear against each other.

Figure 4A:
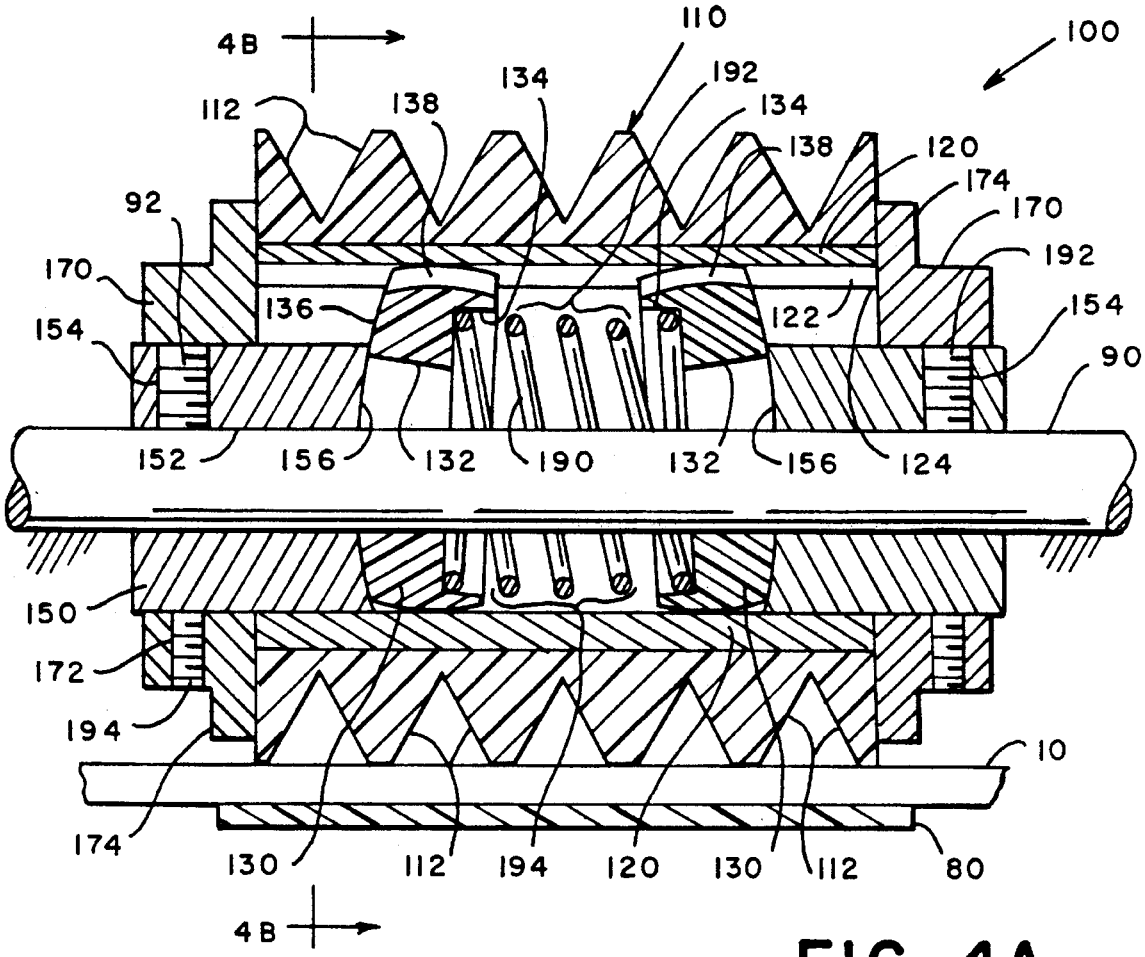
FIG. 4A is a sectional elevational view looking along the path of travel of the article of the pressure roller assembly in a deflected position in accordance with the present invention.
Figure 4B:
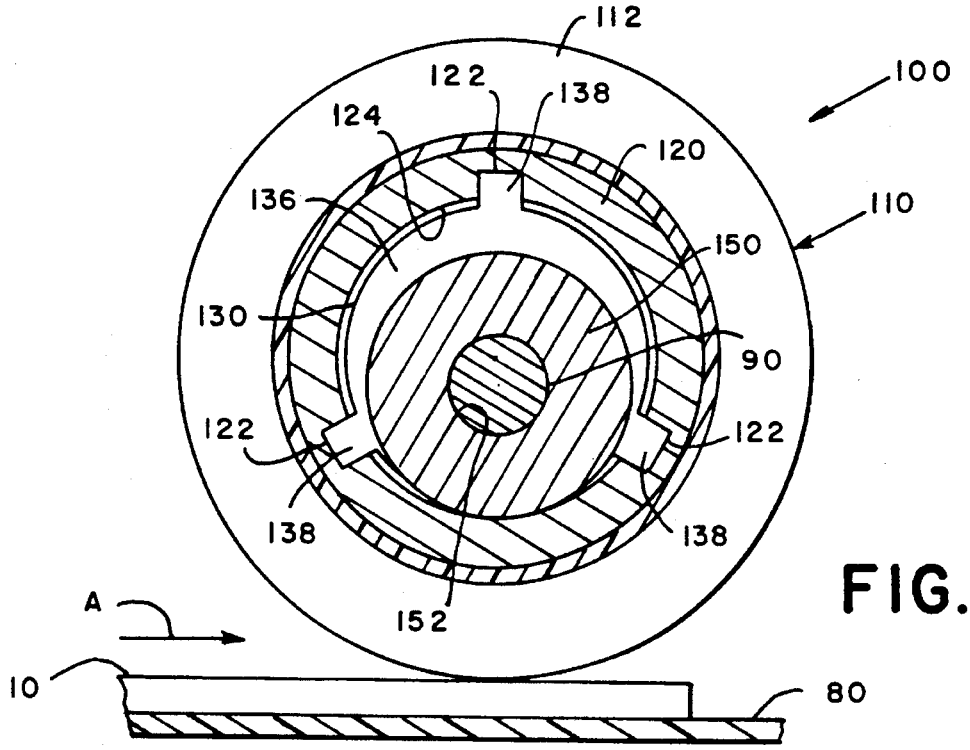
FIG. 4B is a sectional view taken along 4B—4B as shown in FIG. 4A.

Referring to FIGS. 4A and 4B, the compensating pressure roller assembly is shown with the roller 110 in a deflected position. When the article 10 is in the nip between the roller 110 and the drive system 80 the article 10 forces the male hubs 130 to move upward and away from the drive system 80. Thus, the axes of the hole 132 in the male hubs 130, the sleeve 120 and the roller 110 are no longer aligned with those of the shaft 90 and the holes 152 of the female hubs 150. This is possible because of the clearance between the hole 132 in the male hubs 130 and the shaft 90. It is important that the clearance be designed to accommodate the thickest article 10 contemplated because, otherwise, the hole 132 acts as a mechanical stop when is hits the shaft 90. Additionally, the clearance between the outer diameter of the female hubs 150 and the axial sleeve hole 124 be designed to accommodate the thickest article 10. Otherwise, as the roller 110 deflects the axial sleeve hole 124 will hit the outer diameter of the female hubs 150 prevent further upward movement. As shown in FIGS. 4A and 4B, the two mechanical stop conditions discussed above are both present.

As the male hubs 130 reposition, the compression spring 190 maintains the convex spherical surface 136 of the male hubs 130 in operative engagement with the respective concave spherical surface 156 of the female hubs 150. The behavior of the male hubs 130 with the female hubs 150 is analogous, but not identical, to that of a ball and socket joint. Here, the male hubs 130 function as the ball while the female hubs 150 function as the socket. The compression spring 190 insures that the surfaces 136 and 156, respectively, remain in intimate contact.

When the roller 110 is in the deflected position, a top portion 192 of the compression spring 190 is further compressed with respect to the home position while a bottom portion 194 of the compression spring 190 is relaxed with respect to the home position. Thus, the compression spring 190 assumes a twisted or unbalanced configuration. Naturally, the compression spring 190 seeks to return to a balanced configuration but it cannot due to the presence of the article 10. Therefore, the compression spring 190 acts through the male hubs 130, the sleeve 120 and the roller 110 to supply a downward force on the article 10. This force, commonly referred to as a normal force, acts to keep the article 10 in contact with the drive system 80 to fed the article 10 in the path of travel. Accordingly, when the article 10 exits the nip, the compression spring 190 forces all the components of the pressure roller assembly 100 back into axial alignment.

It is important to note that the tabs 138 of the male hubs 130 are rounded so that they do not bind in the grooves 122 of the sleeve 120 as the male hubs 130 move from the home to the deflected position. As best shown in FIG. 4A, the male hubs 130 do not reposition along a linear path but instead slides along the convex spherical surface 156 of the female hubs 150. As best shown in FIG. 4B, in the deflected position, the roller 110 rotates about an imaginary point above the axis of the shaft 90 that depends on the thickness of the article 10.

With the major structural aspects of the present invention described above, the advantages of the present invention over the prior art will now be apparent to those skilled in the art. First, each of the male hubs 130 is capable of movement independent of the other. Therefore, the present invention is less susceptible to the problems associated with off center loading than the prior art. The compression spring 190 will flex accordingly to accommodate any difference in movement between the male hubs 130 and then supply the necessary force to return the male hubs 130 to the home position once the article 10 exits the nip.

Second, the male hubs 130 are not restricted to linear movement but instead may orbit around a variety of positions allowed by the clearance between the shaft 90 and the holes 132. Thus, the male hubs 130 may move up and down, forward and rearward or some combination thereof. For example, if a thin and light article is being fed at a low rate of speed, then as this article 10 enters the nip the male hubs 130 will reposition upward away from the drive system 80. On the other hand, if a thick and heavy article 10 is being fed at a high rate of speed, then as this article 10 enters the nip the male hubs 130 will not only reposition upward but will also reposition rearward in the direction of the path of travel. As the article 10 continues to feed, the male hubs 130 will gradually move forward while remaining at the same upward elevation. Thus, the initial impact of this article 10 is cushioned helping to keep the roller 110 in contact with the article 10 and prevent bounce. Additionally, this capability makes the present invention less dependent on the exact specification of the spring than the prior art. Therefore, the pressure roller assembly 100 of the present invention will accommodate a wider variety of articles 10 without adjustment than the prior art. Those skilled in the art will recognize still further advantages.

Many features of the preferred embodiment represent design choices selected to best exploit the inventive concept as implemented for feeding sheets of paper. However, with minor modifications the present invention may be adapted to feed a wide variety of other types of articles. Additionally, the structural components of the present invention have many known substitutes. Therefore, the invention in its broader aspects is not limited to the specific details of the preferred embodiment. Accordingly, various modifications may be made without departing from the spirit of the general inventive concept as defined by the appended claims and their equivalents.

What is claimed is:

1. In a transport system including a drive system for feeding an article in a path of travel, a pressure roller assembly comprising:

a shaft;

a roller having an inner diameter;

a pair of first hubs each having a bearing surface and fixably mounted to the shaft in spaced apart relationship so that the first hub bearing surfaces are facing each other;

a pair of second hubs each including an through hole having a diameter greater that the shaft diameter and a bearing surface corresponding to the first hub bearing surfaces, respectively, the second hubs spaced along the shaft between the first hubs and slideably mounted to and in bearing engagement with the roller inner diameter so that the second hub bearing surfaces are facing the first hub bearing surfaces, respectively; and means for biasing the second hub bearing surfaces into bearing engagement with the first hub bearing surfaces, respectively.

2. The pressure roller assembly of claim 1 wherein the first hub bearing surfaces have a concave spherical configuration and the second hub bearing surfaces have a convex spherical configuration.

3. The pressure roller assembly of claim 2 wherein the first hubs each have a longitudinal axis in alignment with the axis of the shaft and the first hub concave spherical surfaces each have a center point located on the respective first hub longitudinal axis.

4. The pressure roller assembly of claim 3 wherein the second hubs each have a longitudinal axis and the second hub convex spherical surfaces each have a center point located on the respective first hub longitudinal axis.

5. The pressure roller assembly of claim 4 wherein the roller has an outer diameter and whereby when the article is not present in a nip between the drive system and the roller, the roller is in a home position with the roller outer diameter in contact with the drive system such that the roller and the second hubs are in axial alignment with the shaft and the first hubs, and when the article is present in the nip, the roller is in a deflected position with the roller outer diameter spaced apart from the drive system such that the roller and the second hubs are not in axial alignment with the shaft and the first hubs.

6. In a transport system including a drive system for feeding an article in a path of travel, a pressure roller assembly comprising:

a fixed shaft having an outer diameter;

a roller having an inner diameter and an outer diameter in operative engagement with the drive system;

a pair of female cylindrical hubs each having a longitudinal axis and including a concave spherical surface located on one end of the female hubs having a center point located on the female hub longitudinal axis, the female hubs fixably mounted to the shaft in spaced apart relationship so that the concave spherical surfaces are facing each other;

a pair of male hubs each having a longitudinal axis and including an axial through hole having a diameter greater than the shaft diameter and a convex spherical surface located on one end of the male hubs having a center point located on the male hub longitudinal axis, the male hubs spaced along the shaft between the female hubs with the shaft passing through the male hub axial holes and slideably mounted to and in bearing engagement with the roller inner diameter so that the convex spherical surfaces are facing the concave spherical surfaces, respectively; and a compression spring extending between the male hubs with preload for biasing the convex spherical surfaces of the male hubs into bearing engagement with the concave spherical surfaces of the female hubs, respectively;

whereby when the article is not present in a nip between the drive system and the roller, the roller is in a home position with the roller outer diameter in contact with the drive system such that the roller and the male hubs are in axial alignment with the shaft and the female hubs, and when the article is present in the nip, the roller is in a deflected position with the roller outer diameter spaced apart from the drive system such that the roller and the male hubs are not in axial alignment with the shaft and the female hubs.

* * * * *